US006572305B2

(12) United States Patent
Forrer

(10) Patent No.: US 6,572,305 B2
(45) Date of Patent: Jun. 3, 2003

(54) REFLECTIVE PAVEMENT MARKER

(75) Inventor: Douglas S. Forrer, Heath, OH (US)

(73) Assignee: Pac-Tec, Inc., Heath, OH (US)

( * ) Notice: Subject to any disclaimer, the term of this patent is extended or adjusted under 35 U.S.C. 154(b) by 0 days.

(21) Appl. No.: 09/877,648

(22) Filed: Jun. 8, 2001

(65) Prior Publication Data

US 2002/0187003 A1 Dec. 12, 2002

(51) Int. Cl.[7] ..... E01F 9/06; G02B 5/124; G08B 5/00

(52) U.S. Cl. ..... 404/16; 404/14; 359/530; 359/531

(58) Field of Search ..... 404/14, 16; 359/529–533

(56) References Cited

U.S. PATENT DOCUMENTS 3,332,327 A * 7/1967 Heenan ..... 404/16
3,332,357 A 7/1967 Striebel et al. ..... 104/4
3,409,344 A 11/1968 Balint et al. ..... 350/103
3,984,175 A 10/1976 Suhr et al. ..... 350/103
4,797,024 A 1/1989 Forrer ..... 404/16
5,002,424 A 3/1991 Hedgewick ..... 404/14
5,927,897 A 7/1999 Attar ..... 404/12
6,325,515 B1 * 12/2001 Coderre et al. ..... 359/530

* cited by examiner

*Primary Examiner*—Heather Shackelford
*Assistant Examiner*—Sunil Singh
(74) *Attorney, Agent, or Firm*—Gifford, Krass, Groh, Sprinkle, Anderson & Citkowski, P.C.

(57) ABSTRACT

A reflective pavement marker includes a shell having a top wall, a side wall extending from an end of the top wall, and reflective end walls extending from an other end of said top wall, wherein the shell forms an interior cavity. The reflective pavement marker also includes a reflective portion integral with the reflective end wall, a reflective coating covering the reflective portion and a bonding coating covering at least the reflective portion. The reflective pavement marker further includes a filler material within the interior cavity of the shell.

9 Claims, 1 Drawing Sheet

REFLECTIVE PAVEMENT MARKER

BACKGROUND OF THE INVENTION

1. Field of the Invention

The present invention relates generally to reflective markers and, more specifically, to a reflective pavement marker for a roadway.

2. Description of the Related Art

Reflective markers are frequently positioned on and along roadways to provide a driver of a vehicle with information regarding the road, especially when visibility is poor. For example, a reflective pavement marker is strategically positioned on the roadway to delineate a lane line. A reflective barrier marker is positioned on a barrier separating opposing lanes of traffic to indicate the location of the barrier.

The reflective marker typically includes a shell-like housing having a cavity with an inner surface formed with cube corners reflecting light from a source, such as a headlight of an oncoming vehicle. The inner surface of the cube corners includes a coating of reflective material, such as aluminum. The cavity of the housing may contain a filler material, such as a polyurethane resin, to increase the structural strength of the reflective marker. An example of a reflective pavement marker is disclosed in commonly assigned U.S. Pat. No. 5,002,424 to Hedgewick, entitled "Reflective Pavement Marker With Inclined Reinforcing Ribs"; and U.S. Pat. No. 4,797,024 to Forrer, entitled "Abrasive Resistant Pavement Marker", the disclosures of which are incorporated by reference.

While these reflective pavement markers work well, they are subject to a wide range of environmental conditions that influence their reflective life and reflectivity value. These environmental conditions include ultra-violet (UV) rays from the sun and humidity in the air. One effect of prolonged exposure to UV rays and humidity is separation of the reflective coating from the cube corners and sticking to the filler material, resulting in reduced reflectivity of the marker. Thus, there is a need in the art for a reflective pavement marker that incorporates a bonding coating to prevent the reflective coating on the cube corner from separating from the inner surface of the reflective member and adhering to the filler material, to enhance the reflective life of the reflective pavement marker.

SUMMARY OF THE INVENTION

Accordingly, the present invention is a reflective pavement marker for a roadway. The reflective pavement marker includes a shell having at least one side wall having a reflective portion, wherein the shell forms an interior cavity. The reflective portion has an inner surface partially defining the cavity, and a reflective coating covering the inner surface of the reflective portion and a bonding coating covering at least the reflective coating. The reflective pavement marker further includes a filler material disposed within the interior cavity of the shell.

One advantage of the present invention is that a reflective pavement marker is provided with an enhanced reflective life. Another advantage of the present invention is that a reflective pavement marker is provided with a bonding coating covering at least the inner surface of the reflective portion, to create a moisture barrier. A further advantage of the present invention is that a reflective pavement marker for a highway is provided with improved reflectivity value retention.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Figure 1:
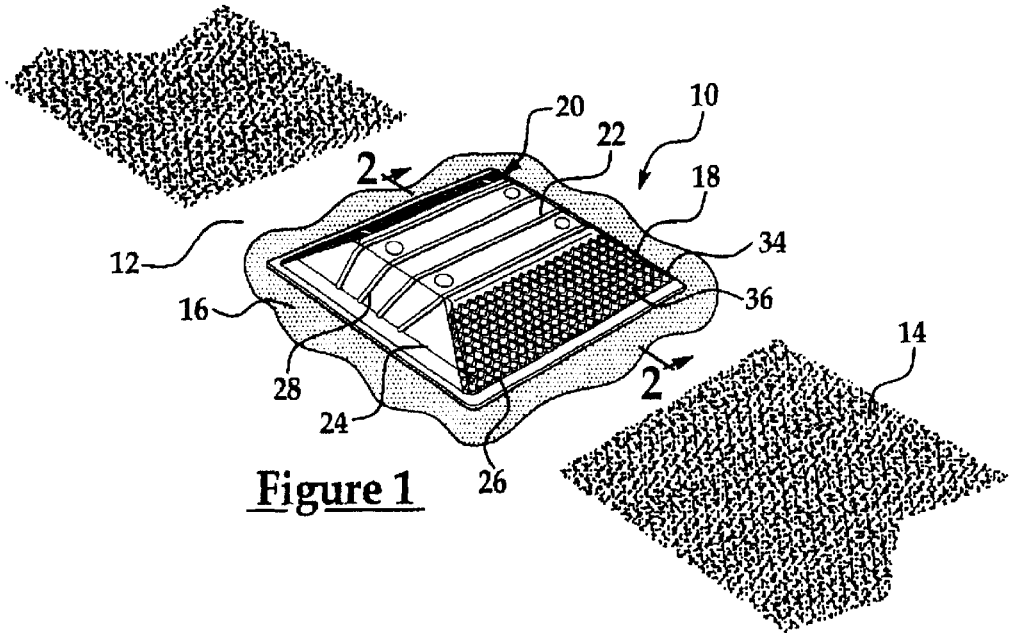
FIG. 1 is a perspective view of a reflective marker positioned in relation to a roadway, according to the present invention.
Figure 2:
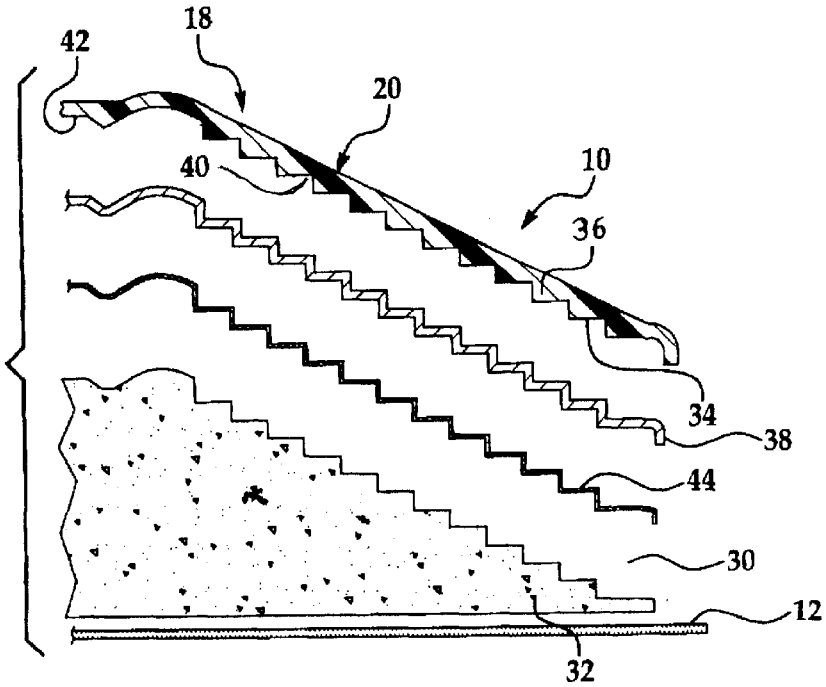
FIG. 2 is a cross-sectional exploded view taken along lines 2—2 of the reflective marker of FIG. 1, according to the present invention.

Referring to FIGS. 1 and 2, a reflective pavement marker 10 is illustrated in relationship to a roadway 12. Advantageously, the reflective pavement marker 10 is utilized to convey information to a driver of a vehicle (not shown), such as a boundary of a lane as delineated by a lane line 14. It should be appreciated that the reflective marker 10 is adhesively secured to a surface, including the roadway 12 of this example, such as by using a bituminous adhesive, as shown at 16.

The reflective pavement marker 10 includes a housing assembly 18. The housing assembly 18 includes a shell 20 having a top wall 22, side walls 24 extending from an end of the top wall 22, and reflective end walls 26 extending from another end of the top wall 22 and extending transversely therebetween the side walls 24. It should be appreciated that the top wall 22, side walls 24 and reflective end walls 26 are integral and formed as one piece. In another example, the shell 20 is manufactured in two halves, which are then joined together to form a single, integral one-piece housing structure 20. The housing structure 20 is made from a wide variety of light transmitting materials that are impervious to high impacts and environmental conditions. An example of such a material is a high impact plastic, such as a polycarbonate or an acrylic.

The shell 20 also includes an integrally formed rib 28 projecting from an inner surface 42 of the shell 20. In this example, the rib 28 projects outwardly from an inner surface of the top wall 22 and side walls 24 and extends transversely between the side walls 24. Further in this example, the projection of the rib 28 forms an acute angle with respect to the inner surface of the top wall 22. The rib provides strength and interlocks with a filler material or potting 32.

The housing assembly 18 includes a reflective portion 34 integrally formed on the inner surface 42 of the shell 20, and in particular the reflective end wall 26. In this example, the reflective portion 34 is a plurality of partial cube-shaped members 36 arranged in a grid pattern and referred to in the art as "cube corners." Similar to a prism, a side of the cube-shaped member 36 forms an angle with a plane of the roadway 12, such that a light beam is reflected back to the eyes of a driver. An example of a cube corner type reflective member is disclosed in U.S. Pat. No. 3,332,357 to Heenan; U.S. Pat. No. 3,409,344 to Balint; and U.S. Pat. No. 3,984,175 to Suhr, the disclosures of which are incorporated by reference.

The housing assembly 18 also includes a reflective coating 38 covering the inner surface 40 of the reflective portion 34. Preferably, the reflective coating 38 is a reflective material, such as aluminum. In this example, the aluminum is bonded to the inner surface 40 of the reflective portion 34 using a process known in the art as vacuum metalizing.

The housing assembly 18 further includes a bonding coating 44 covering at least the reflective coating 38. It should be appreciated that the bonding coating 44 may further cover an inner surface 42 of the shell 20. It has been found that the bonding coating 44 promotes adhesion between the reflective member 34 and the reflective coating 38, although the bonding coating is not disposed between the reflective portion 34 and reflective coating 38. Preferably the bonding coating 44 is a material of the type used for simultaneously priming different materials, as is known in the art. An example of a bonding coating 44 is an acrylic latex primer intended as a lie coating or adhesion promoting primer over plastics, such as KEM AQUA manufactured by Sherwin Williams. Another example of a bonding coating 44 is a water based primer used to promote adhesion between a substrate and a finish coat, and as a lie coat over steel, aluminum, galvanized steel of the like. It should be appreciated that the choice of bonding coating 44 depends on the material characteristics of the housing assembly 18 and reflective coating 38. Preferably, the surface receiving the bonding coating 44 is clean and free of grease, dirt, oxidation products and mold release agents to insure optimum adhesion and coating performance. Advantageously, the reflective life of the reflective pavement marker 10 is enhanced by the use of the bonding coating 44, to promote adhesion between the reflective portion 34 and reflective coating 38 by acting as a moisture barrier. The use of the bonding coating 44 further protects the reflective coating 38 from the effects of UV rays from the sun.

The shell 20 forms a cavity 30, which is filled with a filler material, also referred to as a potting 32, as is known in the art. Advantageously, the inclusion of the filler material 32 in the cavity 30 improves the structural strength of the housing assembly 18. Preferably, the filler material 32 is a polymeric substrate, such as a polyurethane resin. The filler material 32 bonds to the housing structure 20, ribs 28 and the bonding coating 44, to improve the bond between the reflective coating 38 and the reflective member 34.

It should be appreciated that the reflective pavement marker 10 may include other component parts, such as housing structure base (not shown), which are conventional and known in the art for reflective pavement markers.

The method of forming the reflective pavement marker 10 includes the step of forming the shell 20, as disclosed above. The shell 20 is molded in one or two pieces. At least one wall is formed with a reflective portion 34 in the shell 20. The reflective portion 34 has retro reflective "cube corners" 36 formed on the inner surface 42 of the shell 20 during molding. When two pieces are used to form the shell 20, the pieces are glued or sonically welded together along edges which form a centerline for the shell 20. The method also includes the step of placing the shell 20 in a fixture and metalizing the inner surface 40 of the reflective portion 34 with the reflective coating 38, such as aluminum, as known in the art. The method further includes the step of placing the metalized shells 20 in a fixture and passing them on a conveyor, or the like, through a bonding station, where the bonding coating 44 is sprayed on the inner surface 42 of shell 20. It should be appreciated that at least the inner surface 40 of the reflective portion 34 is coated; however, the entire inner surface 42 of the shell 20 defining the cavity 30 may be covered with the bonding material. The method still further includes the step of after the bonding coating 44 dries, inverting the shells 20 in a fixture or carrier, so that the cavity 30 opens upwardly, and moving the shell 20 to a fill station, where the filler material 32 is poured into the cavity 30, covering the bonding coating 44. After the filler material 32 has been cured, the pavement marker 10 is ready for use.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A reflective pavement marker comprising:

a shell having at least one side wall having a reflective portion, wherein said shell forms an interior cavity, said reflective portion having an inner surface partially defining said cavity;

a reflective coating of metal covering said inner surface of said reflective portion;

a filler material filling said interior cavity of said shell; and a bonding coating covering said reflective coating and extending beyond said reflective coating to cover a portion of the inner surface of said shell.

2. A reflective pavement marker as set forth in claim 1 wherein said shell includes a top wall, side wall and reflective end wall with reflective portion that are integral and formed as one piece.

3. A reflective pavement marker as set forth in claim 1 wherein said reflective portion includes a plurality of integrally formed cube-shaped members arranged in a grid pattern.

4. A reflective pavement marker as set forth in claim 1 wherein said bonding coating is a bonding primer.

5. A reflective pavement marker as set forth in claim 4 wherein said bonding primer is an acrylic latex primer.

6. A reflective pavement marker as set forth in claim 4 wherein said bonding primer is a water based primer.

7. A reflective pavement marker comprising:

a shell having at least one side wall having a reflective portion, wherein said shell defines an interior cavity, and said reflective portion and said shell are integral and formed as one piece;

wherein said reflective portion includes a plurality of integrally formed cube-shaped members arranged in a grid pattern on an inner surface;

a reflective coating covering said inner surface of said reflective portion, wherein said reflective coating is a metal material;

a bonding coating covering said reflective coating and extending beyond said reflective coating to coat a portion of the inner surface of said shell to prevent separation of said reflective coating from said reflective portion, wherein said bonding coating is a bonding primer; and a filler material disposed within said cavity of said shell.

8. A reflective pavement marker as set forth in claim 7 wherein said bonding primer is an acrylic latex primer.

9. A reflective pavement marker as set forth in claim 7 wherein said bonding primer is a water based primer.

* * * * *